US009309901B2

(12) United States Patent
Ku

(10) Patent No.: US 9,309,901 B2
(45) Date of Patent: Apr. 12, 2016

(54) FLOW CONTROL VALVE FOR CONSTRUCTION MACHINERY

(75) Inventor: Bon-Seuk Ku, Changwon-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 293 days.

(21) Appl. No.: 14/130,271

(22) PCT Filed: Jul. 12, 2011

(86) PCT No.: PCT/KR2011/005089

§ 371 (c)(1),
(2), (4) Date: Dec. 30, 2013

(87) PCT Pub. No.: WO2013/008965

PCT Pub. Date: Jan. 17, 2013

(65) Prior Publication Data

US 2014/0137732 A1 May 22, 2014

(51) Int. Cl.

| | |
|---|---|
| ***F15B 13/00*** | (2006.01) |
| ***F15B 13/06*** | (2006.01) |
| ***E02F 9/22*** | (2006.01) |
| ***F15B 13/02*** | (2006.01) |
| ***F15B 13/04*** | (2006.01) |
| ***F15B 13/043*** | (2006.01) |
| *F15B 13/042* | (2006.01) |

(52) U.S. Cl.

CPC ..... *F15B 13/06* (2013.01); *E02F 9/2267* (2013.01); *E02F 9/2285* (2013.01); *F15B 13/022* (2013.01); *F15B 13/0402* (2013.01); *F15B 13/043* (2013.01); *F15B 13/042* (2013.01); *Y10T 137/7758* (2015.04)

(58) Field of Classification Search

CPC .. F15B 11/162; F15B 13/022; F15B 13/0402; F15B 13/0422; E02F 9/2267; E02F 9/2285

See application file for complete search history.

(56) References Cited

FOREIGN PATENT DOCUMENTS

| | | | |
|---|---|---|---|
| KR | 10-01451343 | B1 | 8/1998 |
| KR | 10-2001-0042348 | A | 5/2001 |
| KR | 10-0289419 | B1 | 5/2001 |
| KR | 10-2010-0044941 | A | 5/2010 |

OTHER PUBLICATIONS

International Search Report mailed Mar. 9, 2012 for PCT/KR2011/005089.

*Primary Examiner* — Michael Leslie
(74) *Attorney, Agent, or Firm* — Hauptman Ham, LLP

(57) ABSTRACT

A flow control valve for a construction machine is disclosed, which enables a combined operation for simultaneously operating a working device, such as an arm, and a swing device to be easily performed by limiting a part of hydraulic fluid that is supplied to the working device side by a priority valve that is shifted simultaneously or releasing the limiting function through shifting of a spool of the priority valve to a neutral position by pilot signal pressure that is separately applied according to a type of work.

1 Claim, 2 Drawing Sheets

FLOW CONTROL VALVE FOR CONSTRUCTION MACHINERY

CROSS REFERENCE TO RELATED APPLICATION

This application is the National Phase application of International Application No. PCT/KR2011/005089 filed on Jul. 12, 2011, which is incorporated herein by reference in its entirety.

TECHNICAL FIELD

The present invention relates to a flow control valve for a construction machine. More particularly, the present invention relates to a flow control valve for a construction machine, which can limit a part of hydraulic fluid that is supplied to a working device side by a spool of a priority valve that is shifted simultaneously or release the limiting function through shifting of the priority valve to a neutral position by pilot signal pressure that is separately applied according to a type of work when a combined operation for simultaneously operating a working device, such as an arm, and a swing device is performed.

BACKGROUND ART

Generally, in a hydraulic system that is applied to a construction machine, such as an excavator, a plurality of hydraulic pumps are connected to an engine. A left traveling device (TL) and a working device, such as a boom or a bucket, are connected to one of the hydraulic pumps, and a right traveling device (TR), a working device, such as an arm, an option device, and a swing device are connected to the other of the hydraulic pumps.

When a combined operation for simultaneously operating a working device, such as an arm, and a swing device (e.g., excavating earth and sand, performing a swing operation, and loading a dump truck or the like with excavated earth and sand) is performed, a part of a flow rate, which is supplied to a working device side by a priority valve, is limited to secure operability of the swing device that has a relatively large load. Through this, during the combined operation of the arm and the swing device having different loads, the load of the swing device side is increased to secure complex operability.

A flow control valve for a construction machine in the related art, as illustrated in FIG. 1, includes a valve block 3 in which a pump path 4 connected to a hydraulic pump (not illustrated) and connection ports 1 and 2 communicating with a hydraulic actuator (e.g., arm cylinder) are formed; a spool 5 slidably installed inside the valve block 3 and shifted in a left or right direction according to any one of pilot signal pressures Pi1 and Pi2 applied thereto to control hydraulic fluid that is supplied from the pump path 4 connected to the swing device side to the connection ports 1 and 2; and a priority valve 8 mounted on the valve block 3 to limit a flow rate that is supplied from the pump path 4 to a path 7 communicating with the connection port 2 if a control spool 6 is shifted according to pilot signal pressure Pi3 of the swing device side that is simultaneously applied during a combined work for simultaneously operating the working device, such as an arm, and the swing device.

If any one of the pilot signal pressures Pi1 and Pi2 is applied to the valve block 3, the spool 5 is shifted in the left or right direction as shown in the drawing, and thus the hydraulic fluid that is discharged from the hydraulic pump (not illustrated) is supplied to the connection ports 1 and 2 communicating with the actuator (arm cylinder) through the pump path 4, the path 7, and a parallel path 9 in order.

In this case, if the pilot signal pressure Pi3 of the swing device side is simultaneously applied to the priority valve 8 during the combined operation for simultaneously operating the working device, such as the arm, and the swing device, the control spool 6 is shifted (i.e., the pilot signal pressure Pi3 exceeds an elastic force of a valve spring 12) in the right direction as shown in the drawing to lower the flow rate that is supplied from the pump path 4 to the path 7. Accordingly, the hydraulic fluid pressure on the side of the pump path 4 is increased, and thus the hydraulic fluid pressure of the swing device side that communicates with the pump path 4 is increased to secure the complex operability.

DISCLOSURE

Technical Problem

Therefore, the present invention has been made to solve the above-mentioned problems occurring in the related art, and one embodiment of the present invention is related to a flow control valve for a construction machine, which enables a combined operation for simultaneously operating a working device, such as an arm, and a swing device to be easily performed by limiting a part of hydraulic fluid that is supplied to the working device side by a spool of a priority valve that is shifted simultaneously or releasing the limiting function through shifting of a spool of the priority valve to a neutral position by pilot signal pressure that is separately applied.

Technical Solution

In accordance with an aspect of the present invention, there is provided a flow control valve for a construction machine configured to control hydraulic fluid that is distributed and supplied from a hydraulic pump to a hydraulic actuator and a swing device, which includes a valve block in which a pump path connected to the hydraulic pump and connection ports communicating with the hydraulic actuator are formed; a spool slidably installed inside the valve block and shifted according to pilot signal pressure applied thereto to control hydraulic fluid that is supplied from the pump path connected to the swing device side to the connection port side; a priority valve mounted on the valve block to limit a flow rate that is supplied from the pump path to the connection port side when the control spool is shifted according to applied pilot signal pressure of the swing device side; and a piston slidably installed inside a sleeve that is mounted on the priority valve and shifted according to applied pilot signal pressure to shift the control spool to a neutral position so as to release the function of limiting the hydraulic fluid that is supplied from the pump path to the connection port side.

Advantageous Effect

The flow control valve for a construction machine according to the aspect of the present invention as configured above has the following advantages.

when a combined operation for simultaneously operating a working device, such as an arm, and a swing device is performed, a part of hydraulic fluid that is supplied to the working device side by a spool of a priority valve that is shifted simultaneously is limited, or the limiting function is released through shifting of the priority valve to a neutral position by pilot signal pressure that is separately applied according to the type of work to improve workability.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
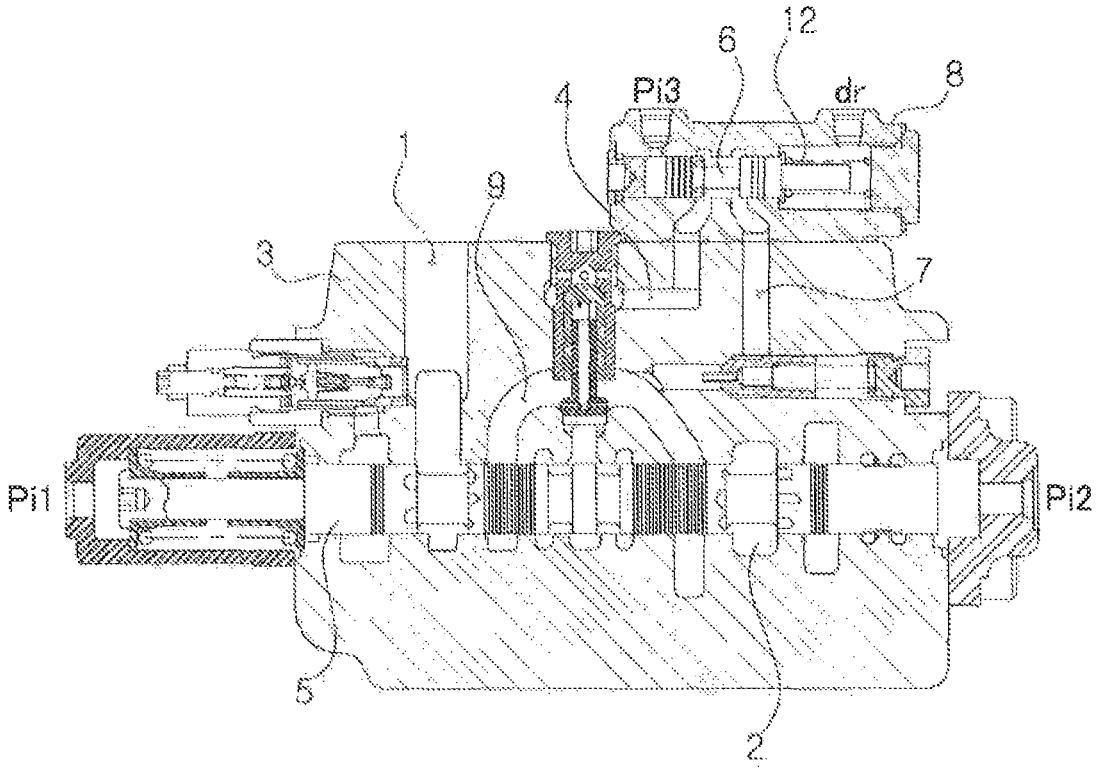
FIG. 1 is a schematic cross-sectional view of a flow control valve for a construction machine in the related art.

1, 2: connection port
3: valve block
4: pump path
5: spool
6: control spool
7: path
8: priority valve
9: parallel path
10: sleeve
11: piston Best Mode Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 2:
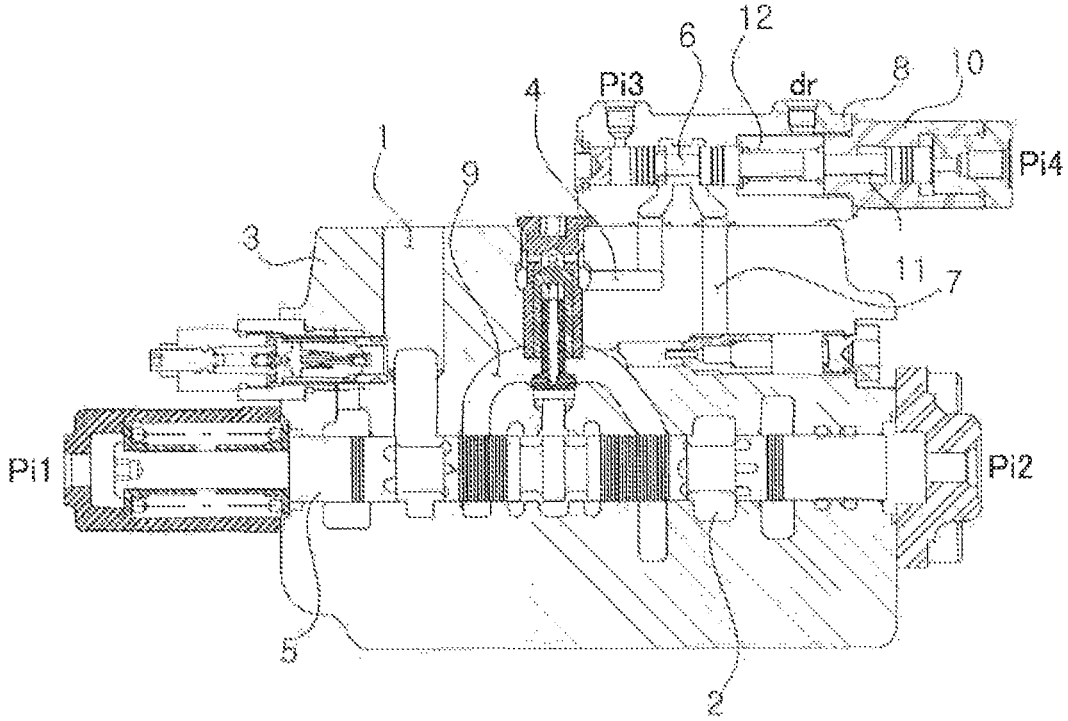
FIG. 2 is a schematic cross-sectional view of a flow control valve for a construction machine according to an embodiment of the present invention.

According to an embodiment of the present invention as illustrated in FIG. 2, a flow control valve for a construction machine, which is configured to control hydraulic fluid that is distributed and supplied from a hydraulic pump to a hydraulic actuator and a swing device, includes a valve block 3 in which a pump path 4 connected to the hydraulic pump (not illustrated) and connection ports 1 and 2 communicating with the hydraulic actuator (e.g., arm cylinder (not illustrated)) are formed; a spool 5 slidably installed inside the valve block 3 and shifted according to any one of pilot signal pressures Pi1 and Pi2 applied thereto to control hydraulic fluid that is supplied from the pump path 4 connected to the swing device side to the side of the connection ports 1 and 2; a priority valve 8 mounted on the valve block 3 to limit a flow rate that is supplied from the pump path 4 to a path 7 communicating with the connection port 2 when the control spool 6 is shifted according to applied pilot signal pressure Pi3 of the swing device side; and a piston 11 slidably installed inside a sleeve 10 that is mounted on the priority valve 8 and shifted according to applied pilot signal pressure to shift the control spool 6 to a neutral position so as to release the function of limiting the hydraulic fluid that is supplied from the pump path 4 to the side of the connection ports 1 and 2.

Hereinafter, a use example of a flow control valve for a construction machine according to an embodiment of the present invention will be described in detail with reference to the accompanying drawings.

As illustrated in FIG. 2, if any one of the pilot signal pressures Pi1 and Pi2 is applied to the valve block 3, the spool 5 is shifted in the left or right direction as shown in the drawing, and thus the hydraulic fluid that is discharged from the hydraulic pump is supplied to the connection ports 1 and 2 communicating with the actuator (arm cylinder) through the pump path 4, the path 7, and a parallel path 9 in order.

In this case, if the pilot signal pressure Pi3 of the swing device side is simultaneously applied to the priority valve 8 during the combined operation for simultaneously operating the working device, such as the arm, and the swing device, the control spool 6 is shifted (i.e., the pilot signal pressure Pi3 exceeds an elastic force of a valve spring 12) in the right direction as shown in the drawing to lower the flow rate that is supplied from the pump path 4 to the path 7. Accordingly, the hydraulic fluid pressure on the side of the pump path 4 is increased, and thus the hydraulic fluid pressure of the swing device side that communicates with the pump path 4 is increased to secure the complex operability.

As described above, after the combined work, in which the flow rate that is supplied to the working device side is limited through simultaneous operation of the working device and the swing device, is completed, the pilot signal pressure Pi4 is applied to the side of the piston 11 that is installed in the sleeve 10 mounted on the priority valve 8, and thus one end of the sliding piston 11 comes in close contact with one end of the control spool 6 that faces the piston 11. Accordingly, the control spool 6 is moved in the left direction in the drawing, and is shifted to a neutral position. Through this, the control spool 6 of the priority valve 8 is kept in the neutral state, and the hydraulic fluid that is supplied to the pump path 4 is supplementarily supplied to the side of the working device (e.g., arm cylinder) through the connection port 2. Accordingly, the driving speed of the working device is increased, and thus the combined operation can be easily performed.

INDUSTRIAL APPLICABILITY

As apparent from the above description, according to the flow control valve for a construction machine according to an embodiment of the present invention, when a combined operation for simultaneously operating a working device, such as an arm, and a swing device is performed, a part of hydraulic fluid that is supplied to the working device side by a spool of a priority valve that is shifted simultaneously is limited, or the limiting function is released through shifting of the priority valve to a neutral position by pilot signal pressure that is separately applied according to the type of work to secure workability and convenience.

The invention claimed is:

1. A flow control valve for a construction machine configured to control hydraulic fluid that is distributed and supplied from a hydraulic pump to a hydraulic actuator and a swing device, comprising:

a valve block in which a pump path connected to the hydraulic pump and connection ports communicating with the hydraulic actuator are formed;

a spool slidably installed inside the valve block and shifted according to pilot signal pressure applied thereto to control hydraulic fluid that is supplied from the pump path connected to the swing device side to the connection port side;

a priority valve mounted on the valve block to limit a flow rate that is supplied from the pump path to the connection port side when the control spool is shifted according to applied pilot signal pressure of the swing device side; and a piston slidably installed inside a sleeve that is mounted on the priority valve and shifted according to applied pilot signal pressure to shift the control spool to a neutral position so as to release the function of limiting the hydraulic fluid that is supplied from the pump path to the connection port side.

* * * * *